United States Patent [19]

Wilkins

[11] 4,282,726

[45] Aug. 11, 1981

[54] ANTI-SLIP FOOTLET SOCK

[75] Inventor: Donald L. Wilkins, Ringgold, Ga.

[73] Assignee: Wayne Gossard, Inc., Nashville, Tenn.

[21] Appl. No.: 89,896

[22] Filed: Oct. 31, 1979

[51] Int. Cl.[3] ..... D04B 9/46

[52] U.S. Cl. ..... 66/172 E

[58] Field of Search ..... 66/172 E, 173, 172 R, 66/170, 171, 180; 2/239

[56] References Cited

U.S. PATENT DOCUMENTS

| | | | |
|---|---|---|---|
| 2,986,025 | 5/1961 | Cormier | 66/172 E |
| 3,013,420 | 12/1961 | Cormier | 66/172 E |
| 3,094,856 | 6/1963 | Monday | 66/180 |
| 3,274,804 | 9/1966 | Thorneburg et al. | 2/239 X |
| 3,990,115 | 11/1976 | Nester | 2/239 |
| 4,034,580 | 7/1977 | Holder | 66/172 E |
| 4,109,492 | 8/1978 | Roberts | 66/172 E |

*Primary Examiner*—Ronald Feldbaum

*Attorney, Agent, or Firm*—Alan Ruderman

[57] ABSTRACT

A knit footlet sock having a roll top foot receiving portion. The top has four courses of elastic make-up followed by four courses of body yarn with elastic inlaid in 1×1 fashion, then eight courses of a bulky stitch of ornamental yarn, followed by a number of courses similar to those immediately preceeding the ornamental yarn. The eight courses of ornamental yarn are knitted in every fourth wale on the outside of the sock with the yarn floated on the inside and includes tuck stitches of elastic intermediate the knit stitches. The bulky courses tend to roll the fabric outwardly away from the ankle and prevents slipping of the sock into a low cut shoe. A method of manufacturing the top of the sock is also disclosed.

8 Claims, 3 Drawing Figures

ANTI-SLIP FOOTLET SOCK

BACKGROUND OF THE INVENTION

This invention relates to a footlet sock adapted to be worn within and substantially covered by a shoe and more particularly to a sock of this type having a rolled top portion provided by a number of courses of a bulky ornamental stitch adjacent the top inner edge providing an inherent rolling tendency.

Short-top or footlet socks are adapted to encircle the lower ankle area and be substantially covered by a low-cut shoe. An annoying problem of these socks is their tendency to slip on the foot and slide down into the shoe. This shortcoming has been recognized in the prior art and various solutions have been proposed. In Thorneburg et al U.S. Pat. No. 3,274,804, a rear ankle tab, formed by partial courses reciprocably knit, is rolled or folded downwardly over the top of the heel of the shoe to prevent the sock from sliding into the shoe. In U.S. Pat. No. 3,990,115, a permanently rolled top is provided by knitting terry loops at the front and rear of the foot receiving opening while the opposite side edges, which are devoid of terry, are tacked down by a non-knitting process. In U.S. Pat. No. 3,000,013, a round tassel is attached to the rear of the top of the foot opening to prevent the sock from slipping into the shoe. Thus, each of the known slip deterents requires a special knitting technique or an additional operation to the knitting of the footlet sock.

SUMMARY OF THE INVENTION

The present invention provides a number of courses of a patterned or ornamental bulky knit stitch floated on the inside of a knit footlet sock just below the initial make-up courses of elastic yarn about the foot opening. The number of courses of the stitch is greater than the number of courses it is spaced from the make-up. By providing an extremely bulky stitch in this manner, the top edge of the sock tends to roll outwardly with a portion of the bulky stitch on the inside and the remainder rolled outwardly over the top. The bulky stitch of the present invention includes elastic stitches knit into the ornamental stitches but held in the tuck position intermediate the knit stitches for the full number of courses of the bulky stitch. This tends to load up the needles that are knitting and provides more bulk to the ornamental courses. The bulk and the closely adjacent location of the stitches relatively to the elastic make-up courses give the stitches an inherent tendency of rolling over on itself. The roll top thus formed provides an anti-slip feature when the sock is worn with low cut shoes.

Consequently, it is a primary object of the present invention to provide a knit footlet sock having an attractive bulky knit stitch floated on the inside of the sock closely adjacent the initial make-up courses of elastic yarn.

It is another object of this invention to provide a knit footlet sock having adjacent an elastic make-up, a novelty knit top formed by an auxiliary yarn knit in spaced wales and floated over the intermediate wales a number of courses, and in which an elastic yarn forms a tuck stitch in an intermediate wale while the auxiliary yarn is knit, the bulky stitches being spaced from the make-up by a lesser number of courses than the number of courses of the bulky stitch.

It is a further object of this invention to provide a knit footlet sock having a bulky elastic stitch within approximately four courses of elastic make-up courses about the foot receiving opening and in which the bulky stitch is formed for approximately eight courses.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENT

Figure 1:
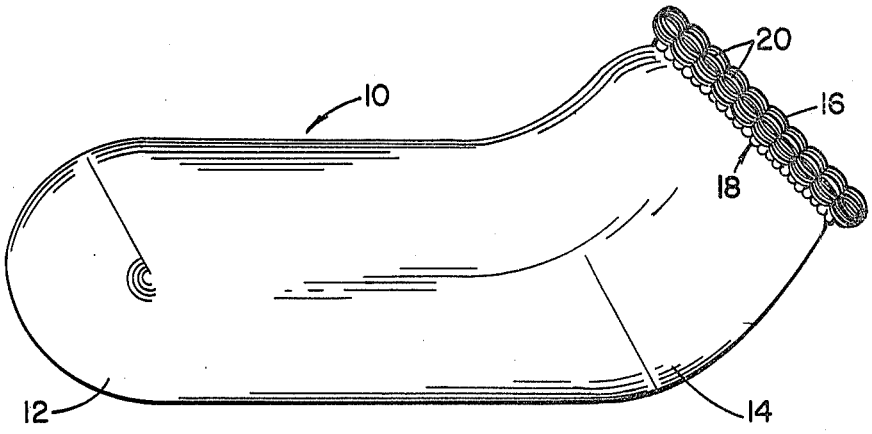
FIG. 1 is an elevational view of the outside of a footlet sock having the foot receiving opening constructed in accordance with the principles of the present invention.

Referring to the drawings the preferred form of the footlet sock 10 includes a toe portion 12, a heel pocket 14 and a top or foot receiving portion 16 adjacent the heel pocket so that it encircles the lower ankle area of the foot of a wearer. Except in the initial courses of the top portion 16 the sock is preferably knit of terry loop stitches 17, the loops being on the inside of the sock. At the uppermost portion of the sock adjacent the elastic make-up or selvage edge 18 the sock is provided with a number of courses of a bulky ornamental stitch 20 which forms the roll top feature of the sock and prevents sliding of the sock into the shoe of the wearer.

Figure 3:
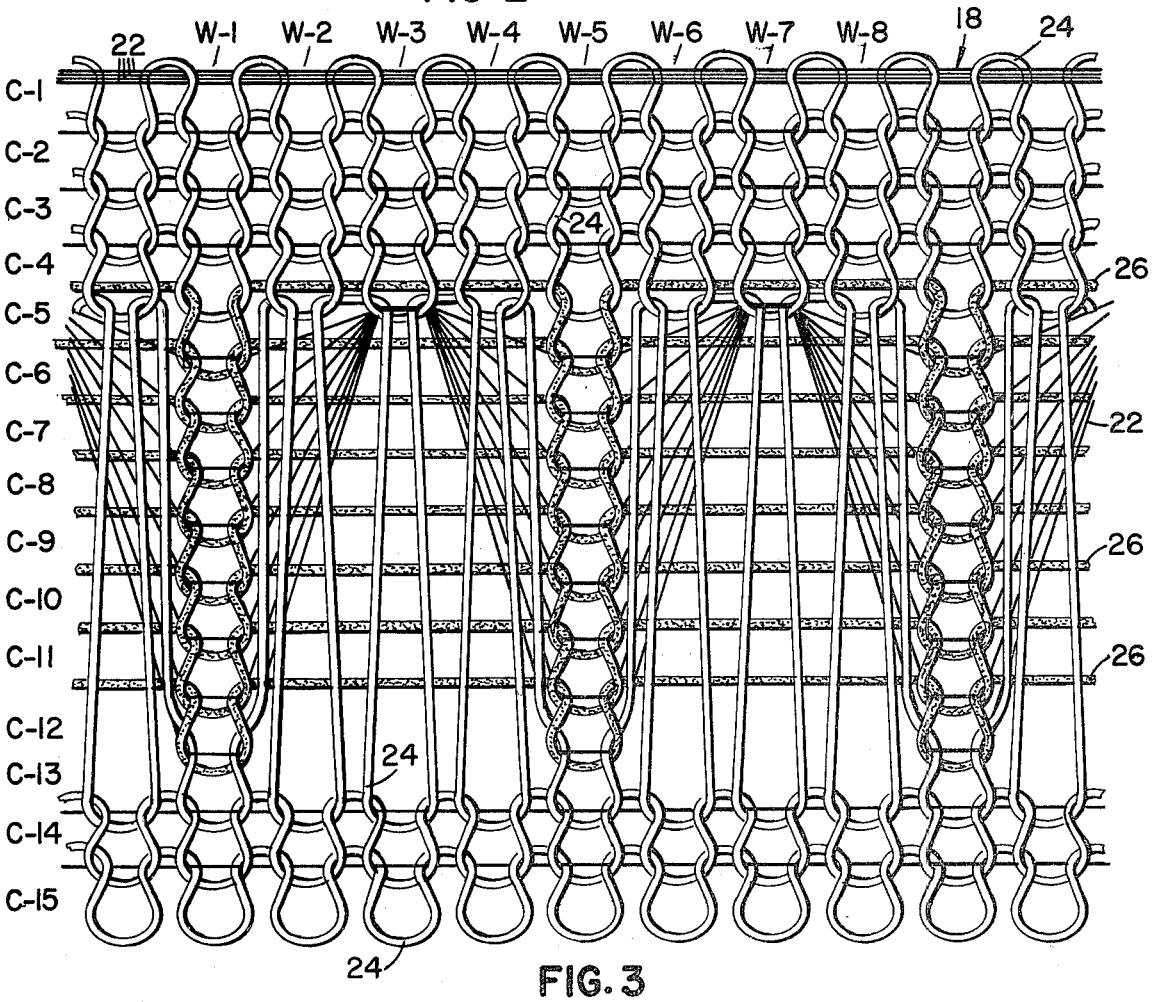
FIG. 3 is a greatly enlarged fragmentary view, somewhat schematic, of the outer top edge of the foot receiving portion of the sock of FIG. 1 in the stretched condition illustrating the manner in which the stitch is formed.

Referring to FIG. 3, a portion of the upper edge of the sock is illustrated in the stretched condition. The upper edge 18 has a make-up, preferably comprising four courses of covered rubber or elastic yarn 22. In the preferred form the make-up is followed by four courses C-1 through C-4 of body yarn 24 knit in $1\times1$ manner with the elastic yarn 22 inlaid into the knit. Some or all four courses C-1 through C-4 may be eliminated without affecting the roll top feature of the present invention. The ornamental or bulky pattern stitch commences in course C-5 and preferably continues for a total of eight courses until course C-12. It appears that best results are obtained when there are at least approximately eight such courses and that it should commence no more than approximately four courses from the make-up courses. If the bulky pattern stitch were to commence more than four courses from the make-up courses it appears that the inherent rolling tendency is reduced or eliminated. This is true if, for example, the pattern stitch commences eight courses from the make-up courses and only extends for four courses. It thus appears that the bulky pattern stitch must at least be spaced from the make-up courses by a lesser number of courses than the number of courses of the bulky pattern stitch, and that this spacing must be less than eight courses and probably no more than approximately four courses.

Figure 2:
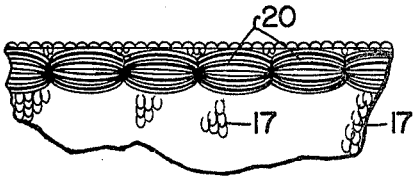
FIG. 2 is an elevational view of a fragment of the inside of the sock of FIG. 1 at the foot receiving opening.

The pattern or ornamental stitch illustrated in courses C-5 through C-12 comprises an auxiliary or decorative yarn 26 which is knit in less wales than that of the body yarn in courses C-1 through C-4. As illustrated, this is preferably in every fourth wale which has given excellent results, but every second, sixth or eight is possible. Thus, the decorative yarn 26 is knit into every fourth wale W-1, W-5, etc. and floated over the other wales. The knitted loops in wales W-1, W-5, etc. of courses C-5 through C-12 are formed on the outside of the socks while the floated yarn in the remaining wales of these courses form the bulky ornamental stitch 20 illustrated in FIGS. 1 and 2. The elastic yarn 22 during the eight courses C-5 through C-12 is laid in with the decorative yarn and forms a tuck stitch in the wales intermediate the knitted wales. Thus, the elastic yarn 22 is inlaid in wales W-1, W-5, etc. and forms a tuck stitch in wales W-3, W-7, etc. It has been found that, although the elastic in courses C-5 through C-12 acts to draw the courses tightly together into a more dense structure, and provides more bulk, no substantial difference in the rolling characteristics appears to result when it is eliminated from an eight course structure spaced four courses from the make-up. No body yarn 24 is used in the formation of courses C-5 through C-12.

The upper edge of the sock is preferably finished off with a number of courses of body yarn and elastic yarn in 1×1 manner. C-13 through C-15 being representative of preferably four such courses, before the remainder of the sock is knit with terry loops. The very bulky ornamental pattern stitch 20 on the inside of the sock in close juxtaposition to the elastic make-up courses 18 acts to roll the make-up course away from the stitch 20. Thus, the make-up rolls toward the outside of the sock and the stitch 20 rolls over with it so that the foot receiving opening is encircled by the stitch 20.

In the production of the sock a conventional sinker top circular knitting machine with an auxiliary feed was used. A five inch 84 needle, ten gauge circular machine has been used in order to accomodate the large amount of yarn used in the decorative top. The make-up is conventionally formed with the elastic 22 alternately fed in front of and under the hook of one needle and floated behind the adjacent needle for four revolutions to form the four elastic courses 18. The body yarn 24 is then introduced with all the needles in the knit position to form loops on all the needles and knit off the make-up. This continues for four rotations to knit courses C-1 through C-4 while the elastic yarn is still fed to the hook side of alternate needles to form the 1×1 inlaid. At the end of the four courses C-1 through C-4, which, as stated above, can be eliminated, all needles are brought down into the hold position, and only every fourth needle, those corresponding to wales W-1, W-5, etc. are brought back up to the knit position. Intermediate needles, corresponding to wales W-3, W-7, etc. are brought partly up to the tuck position, while the remaining needles remain in the hold or inactive position. During the next eight revolutions the auxiliary yarn 26 is fed in preferably by an auxiliary feed to the needles in the knit position while the elastic continues to be laid in. Thus, during the eight courses C-5 through C-12, the needles in the knit position take on decorative yarn and elastic and shed the yarn each course to form the knit loops with inlaid elastic, while the needles in the tuck position take on and hold the elastic yarn. The remaining needles remain in the inactive position and hold the body yarn previously seized in course C-4. After eight revolutions all the needles are brought to the knit position and the decorative yarn feed is terminated. Thus, in course C-13 the body yarn 24 held for the eight courses is knitted off in 1×1 fashion with the elastic laid in. The elastic held in the tuck position by the needles in wales W-3, W-7, etc. are shed as the needle now knits, and the eight courses are drawn together. The remaining courses of the top are knit with body yarn with elastic inlaid in 1×1 manner. The remainder of the sock is then knit by conventional terry methods.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A knit footlet sock adapted to be worn inside of a low cut shoe comprising, a foot portion including a toe portion and a heel embracing portion, a foot receiving portion positioned above and closely adjacent said heel embracing portion and adapted to encircle the ankle area of a wearer, said foot receiving portion including a roll top having the inherent tendency to roll outwardly from the ankle area of the wearer, said roll top comprising a plurality of courses of elastic yarn inlaid in a predetermined number of wales of a body yarn forming an outer selvage of the foot receiving portion, and a number of courses of an ornamental yarn forming a bulky stitch comprising several courses commencing with a first course spaced from the outer selvage by a lesser number of courses of said bulky stitches, said stitch being knit on the outside of said foot receiving portion in spaced wales of said predetermined number and floated over the wales intermediate said spaced wales on the inside of said foot receiving portion.

2. A knit footlet sock as recited in claim 1 wherein said bulky stitch comprises approximately at least eight courses, and said first course is disposed no further than approximately four courses from said selvage.

3. A knit footlet sock as recited in claim 2 wherein said outer selvage comprises at least four elastic courses.

4. A knit footlet sock as recited in claim 1 wherein said bulky stitch includes elastic yarn inlaid into said spaced wales and forming a tuck stitch in wales intermediate said spaced wales, thereby to draw said courses of ornamental yarn together.

5. A knit footlet sock as recited in claim 1 wherein there are a number of courses of body yarn knit in each of said predetermined courses with elastic yarn inlaid in 1×1 fashion immediately before and after said courses of ornamental yarn, and the course of body yarn next adjacent said first course is knitted with the course next immediately adjacent the last course of said ornamental yarn.

6. A knit footlet sock as recited in claim 5 wherein said bulky stitch includes elastic yarn inlaid into said spaced wales and forming a tuck stitch in wales intermediate said spaced wales, thereby to draw said courses of ornamental yarn together.

7. A knit footlet sock as recited in claim 4 wherein said bulky stitch comprises approximately at least eight courses, and the first course is disposed no further than approximately four courses from said selvage.

8. A knit footlet sock as recited in claim 7 wherein said outer selvage comprises at least four elastic courses.

* * * * *